US008365351B2

(12) United States Patent
Windmeisser

(10) Patent No.: US 8,365,351 B2
(45) Date of Patent: Feb. 5, 2013

(54) FLOOR CLEANING MACHINE COMPRISING A VERTICALLY MOVABLE WATER SLIDER

(75) Inventor: Dieter Windmeisser, Fruthwilen (CH)

(73) Assignee: Diversey, Inc., Sturtevant, WI (US)

( * ) Notice: Subject to any disclaimer, the term of this patent is extended or adjusted under 35 U.S.C. 154(b) by 825 days.

(21) Appl. No.: 11/910,643

(22) PCT Filed: Mar. 30, 2006

(86) PCT No.: PCT/US2006/012068

§ 371 (c)(1),
(2), (4) Date: Oct. 2, 2009

(87) PCT Pub. No.: WO2006/107781

PCT Pub. Date: Oct. 12, 2006

(65) Prior Publication Data

US 2010/0154149 A1 Jun. 24, 2010

(30) Foreign Application Priority Data

Apr. 4, 2005 (EP) ..... 05007304

(51) Int. Cl.

| | |
|---|---|
| ***A47L 5/34*** | (2006.01) |
| ***A47L 5/00*** | (2006.01) |
| ***A47L 9/06*** | (2006.01) |
| ***A47L 9/04*** | (2006.01) |

(52) U.S. Cl. ..... 15/361; 15/401; 15/373

(58) Field of Classification Search ..... 15/401, 15/361, 373

See application file for complete search history.

(56) References Cited

U.S. PATENT DOCUMENTS

| | | | | |
|---|---|---|---|---|
| 1,520,769 | A * | 12/1924 | Peterson | 15/52 |
| 1,694,937 | A | 12/1928 | Floeter | |
| 1,979,797 | A * | 11/1934 | Finnell | 15/50.1 |
| 2,282,950 | A * | 5/1942 | Dunbar | 15/358 |
| 2,485,363 | A * | 10/1949 | Coss | 15/361 |

(Continued)

FOREIGN PATENT DOCUMENTS

| | | |
|---|---|---|
| DE | 3518544 | 9/1986 |
| DE | 3518544 C1 * | 9/1986 |

(Continued)

OTHER PUBLICATIONS

The International Search Report prepared by the European Patent Office.

*Primary Examiner* — Bryan R Muller

(74) *Attorney, Agent, or Firm* — Michael Best & Friedrich LLP

(57) ABSTRACT

Water slider for a floor cleaning machine 1, comprising a sliding unit 2 located in front of the brush unit 5 of the machine, characterized by actuating means 3, 6, 13; 3, 6', 11, 12; 3, 6, 7; 3, 6, 7'; 3, 6, 7"; 3, 6', 10; 3, 6', 10'; 3, 6', 10" for raising and lowering the sliding unit. The actuation of the water slider can be obtained in several ways: automatically via an actuating bar 3 which connects the sliding unit to the driving wheels of the machine mechanically and which raises/lowers the sliding unit on a forward/backward movement of the wheels; intuitively via a mechanical connection of the bar 3 to the steering handle 8 via a negative gear transmission; manually via an actuating lever 7; 7'; 7"; or by a powered mechanism 10; 10'; 10" which is steered by the electronics of the machine and which raises/lowers the water slider when the machine is moved forward/backward.

4 Claims, 10 Drawing Sheets

U.S. PATENT DOCUMENTS

| | | | |
|---|---|---|---|
| 2,740,147 | A | 4/1956 | Bailey |
| 3,939,518 | A | 2/1976 | Whitney et al. |
| 4,173,056 | A | 11/1979 | Geyer |
| 4,619,010 | A | 10/1986 | Burgoon et al. |
| 4,817,233 | A | 4/1989 | Waldhauser |
| 5,147,002 | A | 9/1992 | Hughes et al. |
| 5,467,500 | A | 11/1995 | O'Hara et al. |

FOREIGN PATENT DOCUMENTS

| | | |
|---|---|---|
| DE | 19718497 | 11/1998 |
| EP | 0792614 | 3/1991 |
| EP | 0621004 | 10/1994 |
| EP | 0800783 | 10/1997 |
| GB | 486499 | 6/1938 |

* cited by examiner

FLOOR CLEANING MACHINE COMPRISING A VERTICALLY MOVABLE WATER SLIDER

TECHNICAL FIELD

The present invention relates to a water slider for a floor cleaning machine according to the preamble of claim 1.

BACKGROUND AND STATE OF THE ART

Various powered floor cleaning machines are known in the art. Generally, they comprise a rotating brush or pad unit and a suction unit, usually in the form of so-called squeegees, located behind the brush unit for drawing up the cleaning liquid applied to the ground. Since the squeegee is located on the rear part, such machines can only be operated in one direction. Water pick-up is complicated, if not impossible, when the machine is moved under tables, into edges or dead end areas etc. where it is difficult or impossible to turn the machine around in order to pick up the cleaning solution with the squeegee which is positioned behind the brush or pad. This problem occurs particularly in congested areas which are mostly cleaned with small automatic machines, but it can also occur in connection with bigger machines in super or hyper markets, f.e., if palettes for refilling the shelves are in the way.

Several approaches to attack this problem are known. GB-A-486 499 discloses a floor treating machine wherein the suction unit consists of a suction nozzle which is movably mounted in such a way that its position is variable angularly in a horizontal direction in relation to the brush. U.S. Pat. No. 4,173,056 discloses a floor scrubbing machine having two brushes and a suction unit consisting of a vacuum squeegee water pick-up system the position of which is controlled by a steering arm. Due to the complex design of the movable suction unit, these systems are rather complicated, accident sensitive and expensive.

Another approach consists in providing a second squeegee in front of the brush or pad unit. U.S. Pat. No. 4,817,233 discloses a floor scrubbing machine having a cylindrical scrub brush, a suction squeegee behind the brush and another one in front of the brush, with both squeegees being connected to a vacuumized collection tank. The flexible squeegee lips are mounted in such a way that when the machine is moved forward the lips of the front squeegee fold together and shut off the airflow to it while the rear squeegee remains functional; when the machine is moved backward a reverse action of the squeegee occurs. EP-B-0 792 614 and EP-B-0 800 783 disclose an apparatus for cleaning a ground having a cylindrical brush and suction squeegees in front of the brush and behind the brush. The squeegees comprise a strip of rubber material and are designed in such a way that the rubber wearing component is easily replaceable. However, although there are embodiments available for machines with cylindrical brush units (i.e., machines comprising a cylindrical brush which is rotated around an axis parallel to the surface plane) as well as for machines with disc units (i.e., machines comprising a flat disc being fitted with brushes or pads which is rotated around an axis perpendicular to the surface plane), all of these embodiments have several drawbacks in common. The arrangement with front and rear squeegees makes an air-steering system necessary as the suction performance is limited. Furthermore, the front squeegee in the prior art systems is always in operation, i.e., it always touches the ground.

Due to running on dry floor most of the time, this leads to high wear and tear, friction, a higher power-consumption and/or lower suction performance.

SUMMARY OF THE INVENTION

It is thus an object of the present invention to provide a front water slider for a floor cleaning machine which can be used for cylindrical as well as disc systems and which is designed in such a way that there is no need for complex arrangements in order to compensate for higher friction and lower suction performance as is the case in known systems.

This is achieved by a water slider for a floor cleaning machine with the features as described in claim 1. The present invention discloses a water slider which is located in front of the cylindrical or disk shaped brush unit and which can be raised and lowered automatically or manually.

According to the present invention, the water slider for a floor cleaning machine comprises a sliding unit located in front of the brush unit of the machine, characterized by actuating means for raising and lowering the sliding unit.

In a first embodiment, the water slider is raised and lowered automatically by means of a bar which is mechanically connected to the wheels such that backward movement of the wheels lowers the sliding unit whereas forward movement of the wheels raises the sliding unit.

In a second embodiment, the sliding unit is raised and lowered intuitively by means of the steering handle of the machine which is slightly pushed forward or pulled backward (depending on the moving direction of the machine), thereby raising and lowering the sliding unit via a mechanical connection thereto.

In a third embodiment, the sliding unit is raised and lowered manually by means of a separate hand or foot actuating lever.

In a fourth embodiment, a powered mechanism which is steered by the electronics of the machine lowers the sliding unit when the machine is moved backward and raises the sliding unit when the machine is moved forward.

BRIEF DESCRIPTION OF THE DRAWINGS

FIG. 4*a-c* show oblique views from above of a floor cleaning machine with a disc unit which is equipped with a water slider according to a fourth embodiment of the present invention wherein the water slider is not actuated mechanically and/or manually but instead via a motor, a magnet or the like.

DESCRIPTION OF THE PREFERRED EMBODIMENTS

Figure 1A:
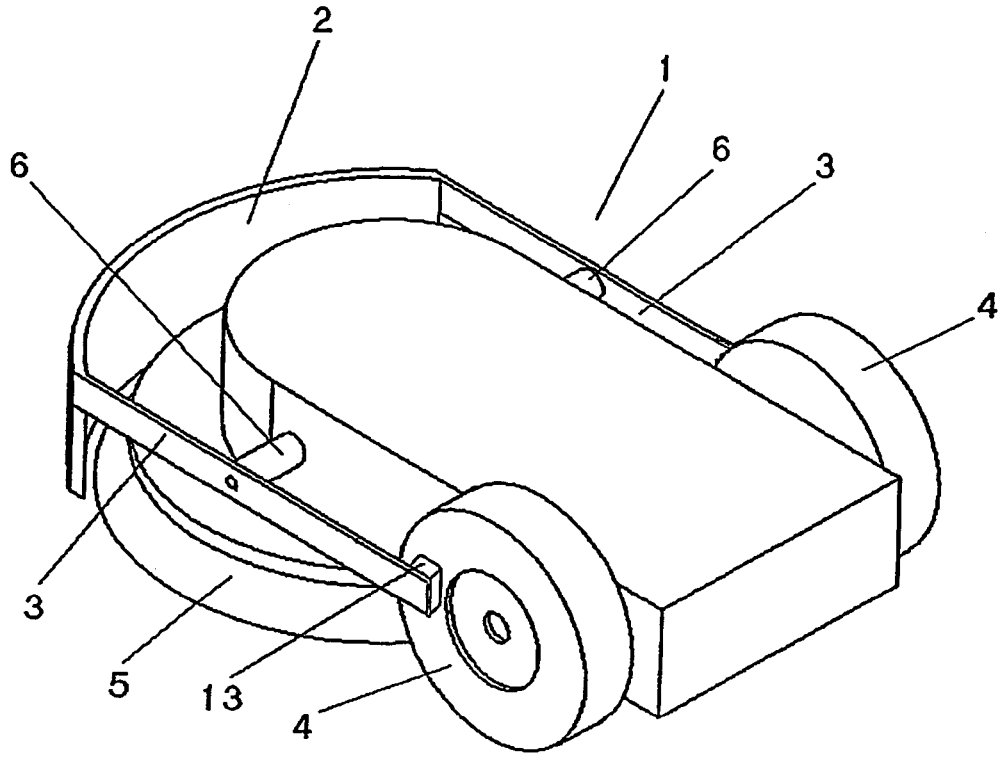
FIG. 1*a* shows an oblique view from above of a floor cleaning machine with a disc unit which is equipped with a water slider according to a first embodiment of the present invention wherein the water slider is actuated mechanically via the movement of the drive wheels.
Figure 1B:
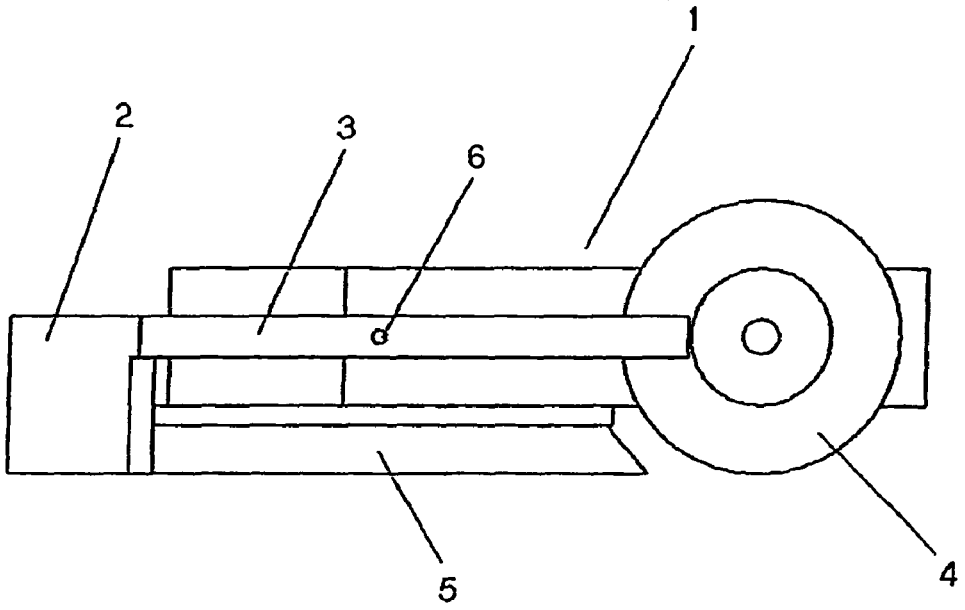
FIG. 1*b* shows a side view of the machine of FIG. 1 with the water slider in a lowered position.
Figure 1C:
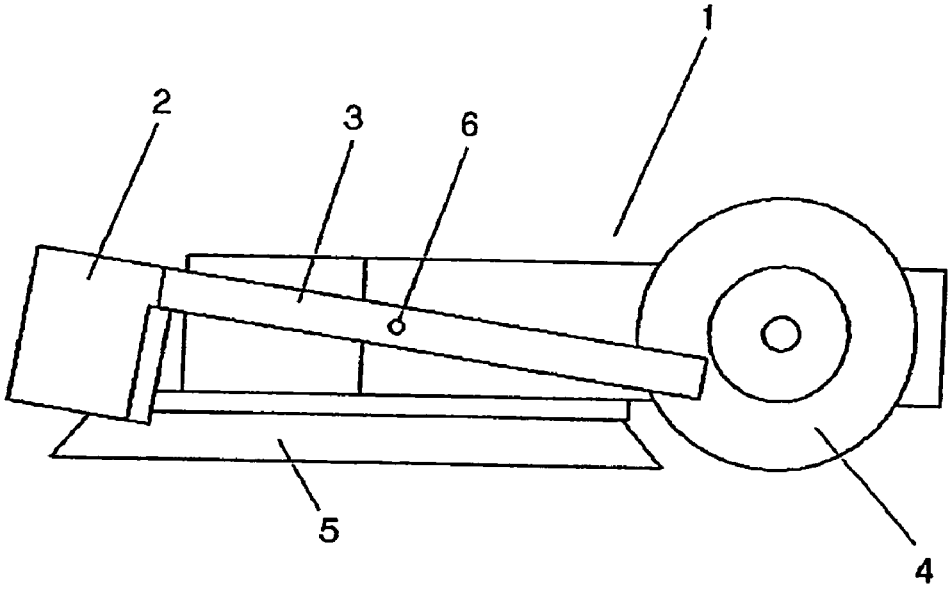
FIG. 1*c* shows the side view of the machine of FIG. 2 but with the water slider in a raised position.

FIGS. 1*a-c* illustrate a water slider for a floor cleaning machine 1 according to a first embodiment of the present invention. The water slider is located in front of the brush unit 5 and comprises a sliding unit 2 which is fitted to a bar 3 on both sides of the machine. At its rear ends, the bar 3 is connected to the wheels 4 of the machine in such a way that a backward movement of the wheels 4 lowers the bar 3 and, thus, the sliding unit 2 connected thereto, whereas a forward movement of the wheels 4 raises the bar 3 and the sliding unit 2. To achieve this upward/downward movement, the bar 3 is mounted on both sides of the machine like a lever with pivot points 6, wherein the rear ends of the bar 3 are connected to the respective outer sides of the front segment of the wheels 4—"front segment" means the part of the wheels which is directed towards the front side of the machine. The connection between the ends of the bar and the respective wheels is achieved by conventional brake pads 13 which are pressed against the side of the drive wheels by the ends of the bar 3. Thus, during forward movement of the machine, the ends of the bar 3 are pushed downward to a certain extent due to the brake pad connection. This in turn raises the sliding unit 2 due to the functioning of the bar 3 as a lever around pivot points 6. In an analogous manner, the ends of the bar 4 are pushed upward during backward movement of the machine, thus lowering the sliding unit 2. The pad pressure is preferably adjustable to generate just enough friction to lift the mechanism and to generate enough pressure of the sliding unit 2 in its lowered state on the floor to achieve good cleaning results.

Figure 2:
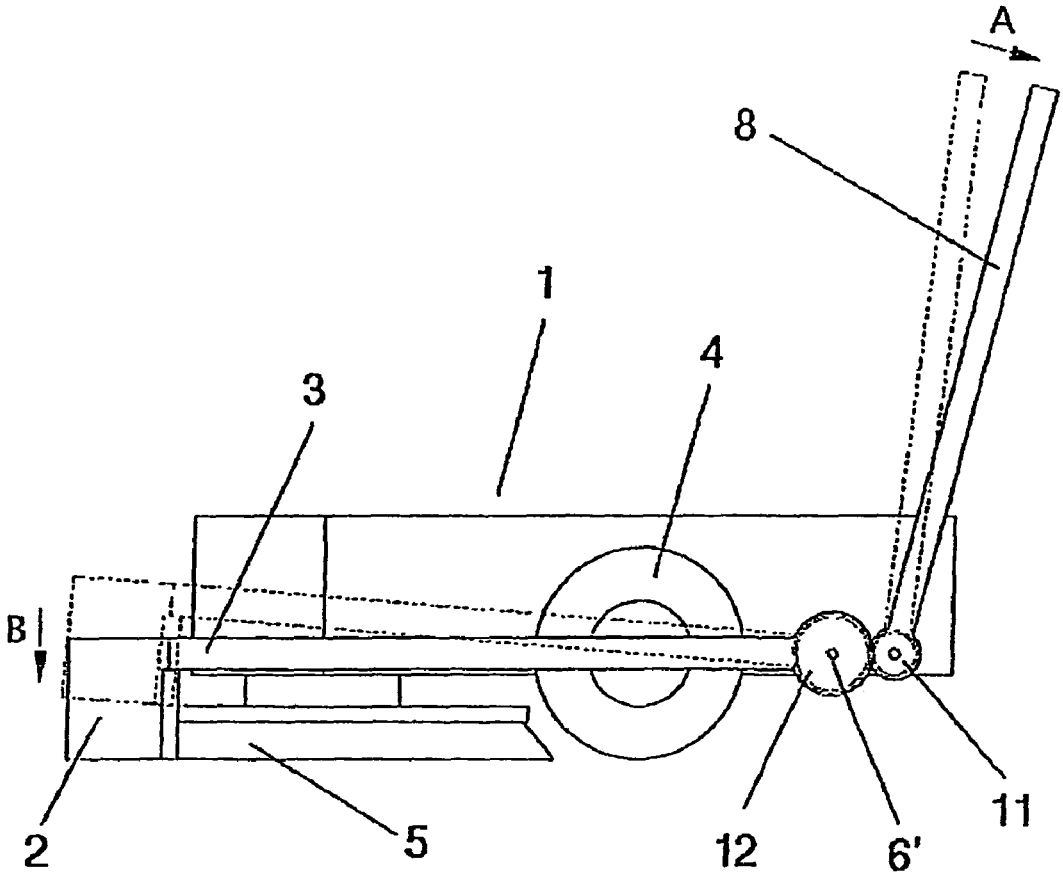
FIG. 2 shows a side view of a floor cleaning machine with a disc unit which is equipped with a water slider according to a second embodiment of the present invention wherein the water slider is actuated intuitively via the steering handle of the machine.

FIG. 2 illustrates a water slider for a floor cleaning machine 1 according to a second embodiment of the present invention. The sliding unit 2 is connected to a bar 3 which is mounted on both sides of the machine via pivot points 6'. The ends 12 of the bar 4 are round and thereby form gears with the pivot points 6' as their respective central axes. A handle 8 which is normally used for controlling and steering the machine—in particular for pushing it forward and pulling it backward—is pivotally connected to the machine on both sides via its ends 11 which are also round and thereby form gears. The gear ends 11 of the steering handle 8 adjoin the respective gear ends 12 of the bar such that they engage each other thereby creating a negative gear transmission. In this way, an intuitive actuation of the sliding unit 2 is achieved: if the machine is pushed forward by the operator, steering handle 8 is also pivoted forward to a certain extent which in turn raises the sliding unit 2 (indicated by the dashed lines in FIG. 2) due to the negative gear transmission between steering handle 8 and bar 3; when pulling the machine backward, steering handle 8 is also pivoted backward to a certain extent which in turn lowers the sliding unit 2 due to the negative gear transmission between steering handle 8 and bar 3. The pivoting range of steering handle 8 is limited corresponding to the vertical movement range of sliding unit 2. The gear ends 11 and 12, resp., can be formed as toothed wheels or they can be provided with surfaces which permit sufficient friction between the gears.

Figure 3A:
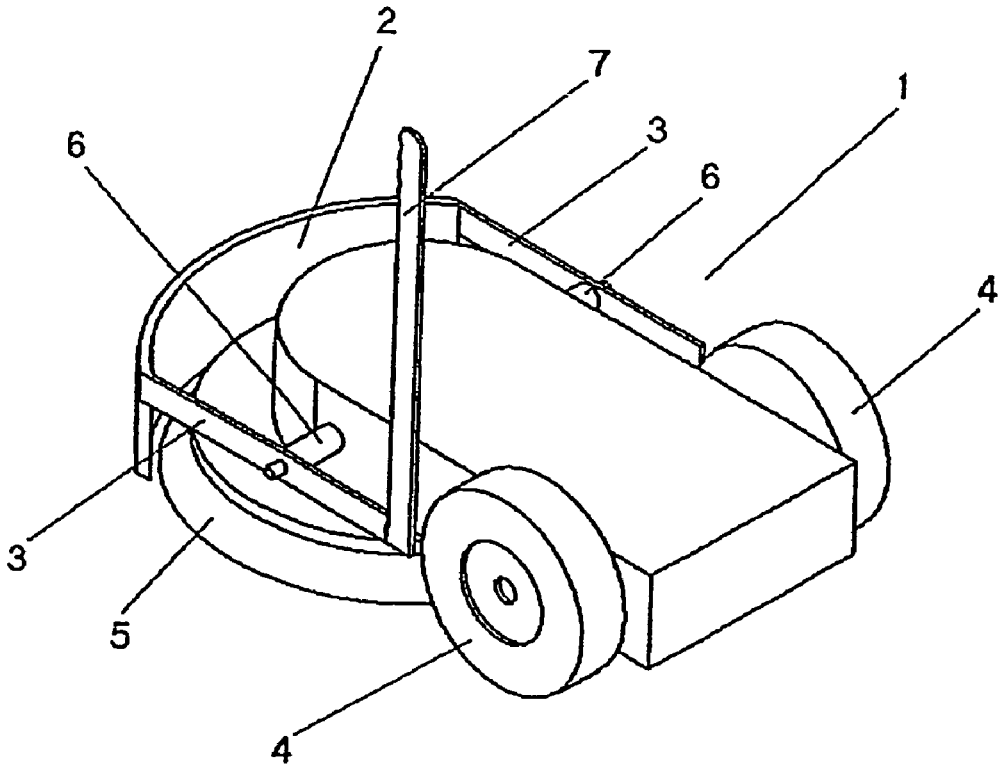
FIG. 3*a-c* show oblique views from above of a floor cleaning machine with a disc unit which is equipped with a water slider according to a third embodiment of the present invention wherein the water slider is actuated manually.
Figure 3B:
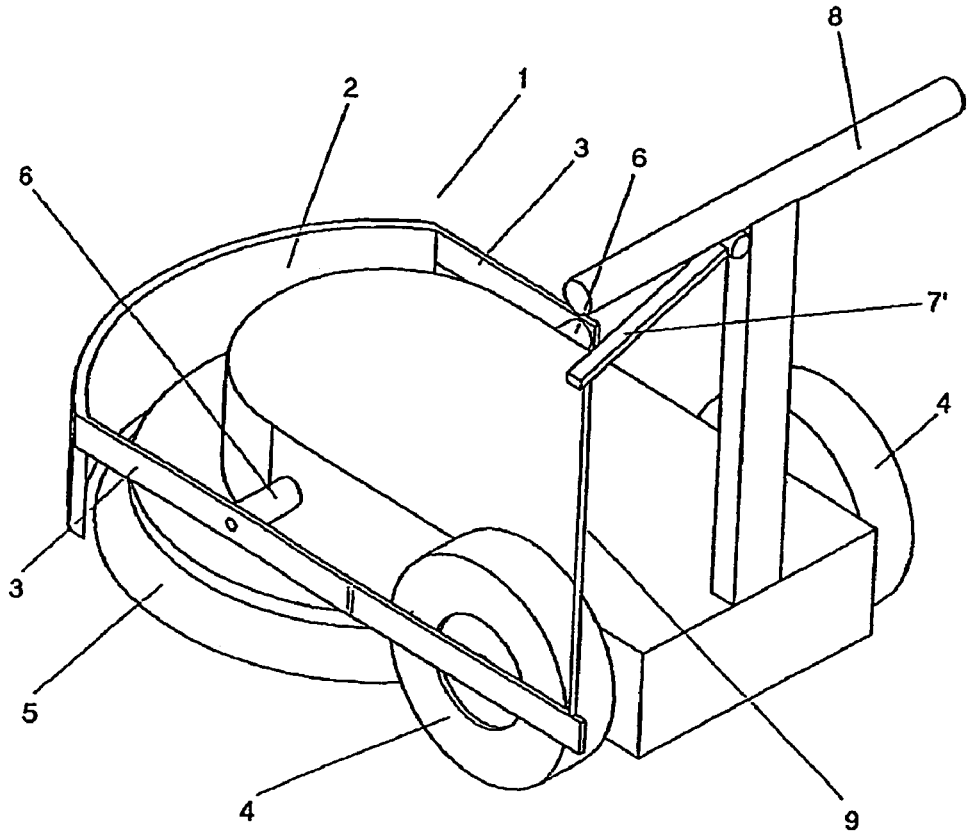
Figure 3C:
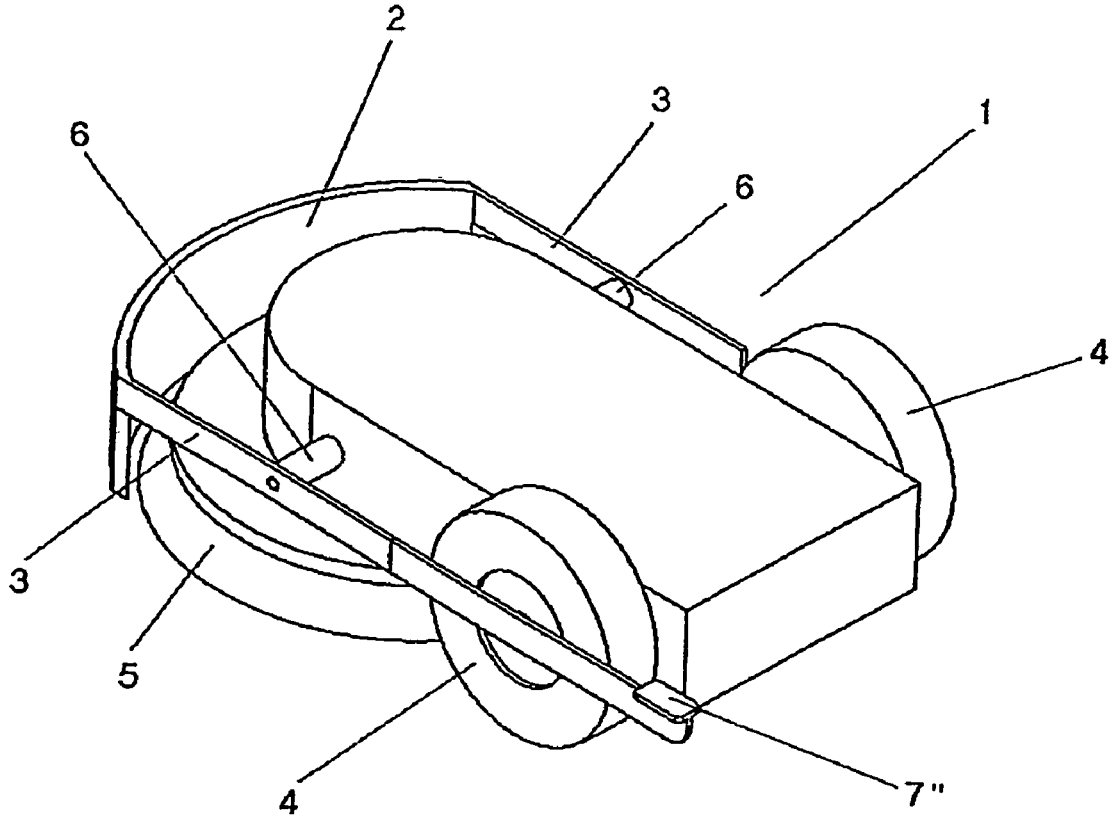

FIG. 3*a-c* illustrate a water slider for a floor cleaning machine 1 according to a third embodiment of the present invention. Here, the sliding unit 2 is connected to a bar 3 which is mounted on one side of the machine like a lever with pivot point 6. However, instead of being raised and lowered automatically via its connection to the rear wheels 4 as in the first embodiment or intuitively via its connection to the steering handle 8 as in the second embodiment, the sliding unit 2 is now raised and lowered completely manually. For this purpose, the bar is connected to an actuation lever 7, 7', 7". In the case of an actuation by hand, the actuation lever 7, 7' should preferably be positioned dose to the steering handle 8 of the machine (cf. FIG. 3*a/b*). In case of an actuation by foot, the actuation lever 7" should be positioned at rear end of the bottom of the machine close to the position of the operator (cf. FIG. 3*c*). The connection between sliding unit 2 and actuation lever 7, 7', 7" can be achieved in various ways—f.e., via a direct rigid connection (cf. FIG. 3*a/c*), a bar-linkage (with or without gear ratio) or a bowden cable 9 (cf. FIG. 3*b*).

Figure 4A:
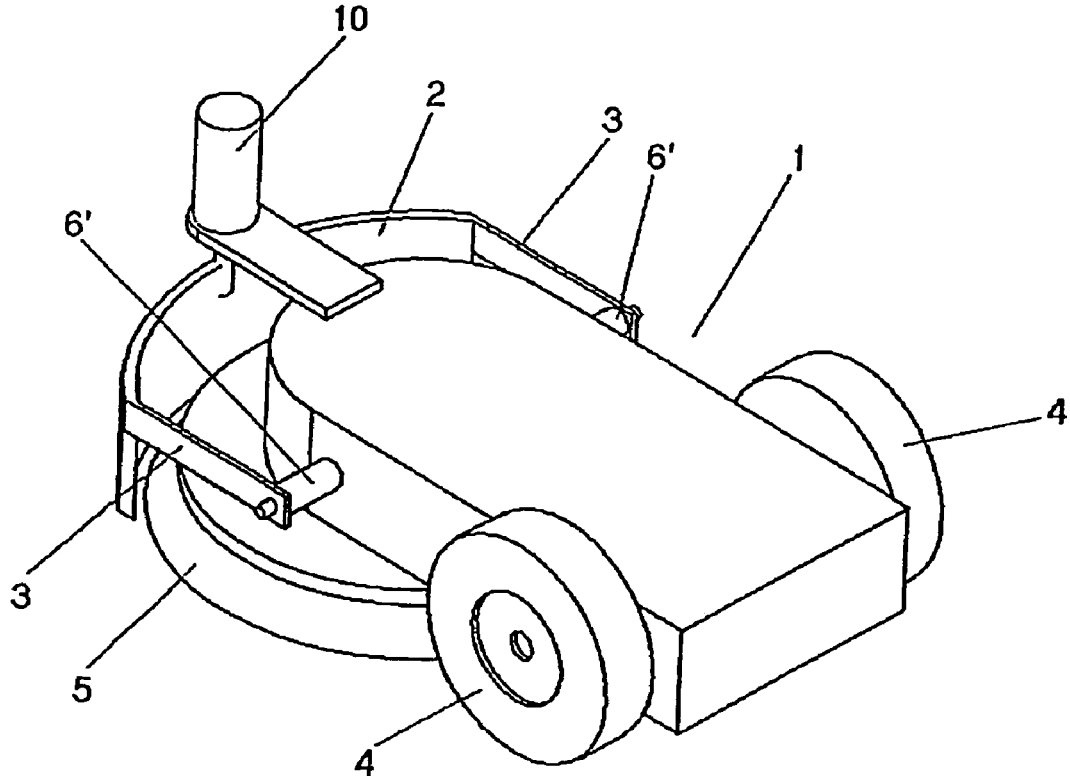
Figure 4B:
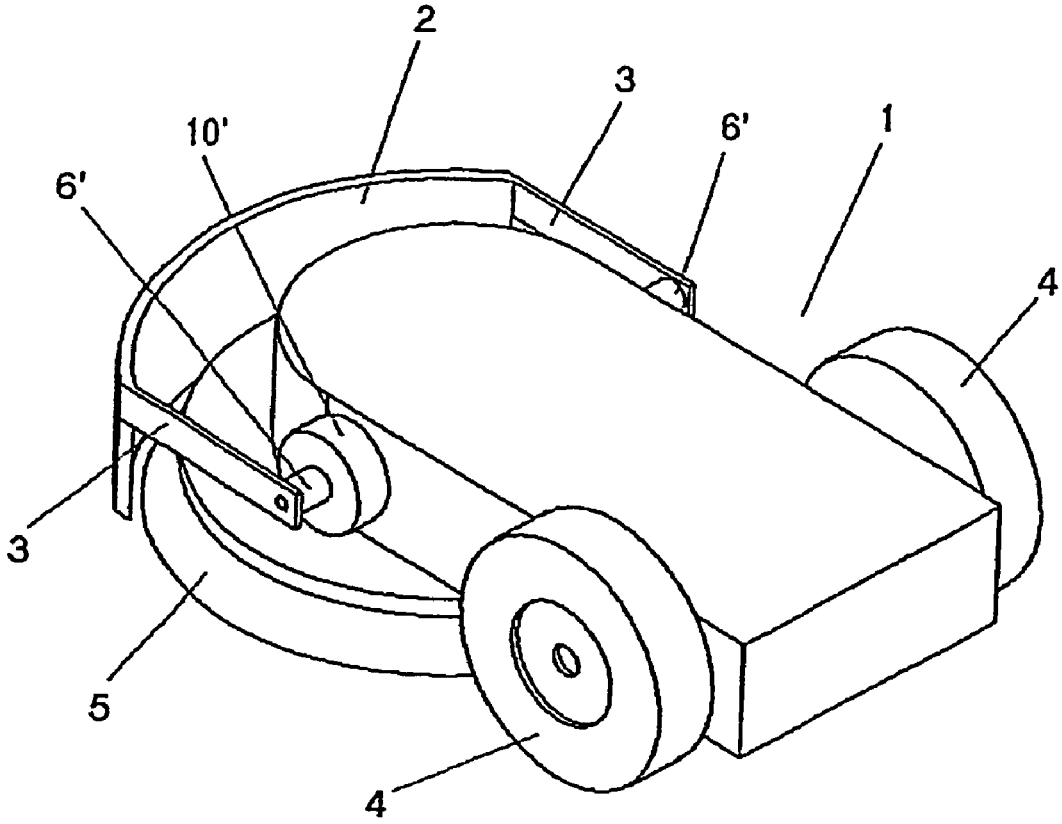
Figure 4C:
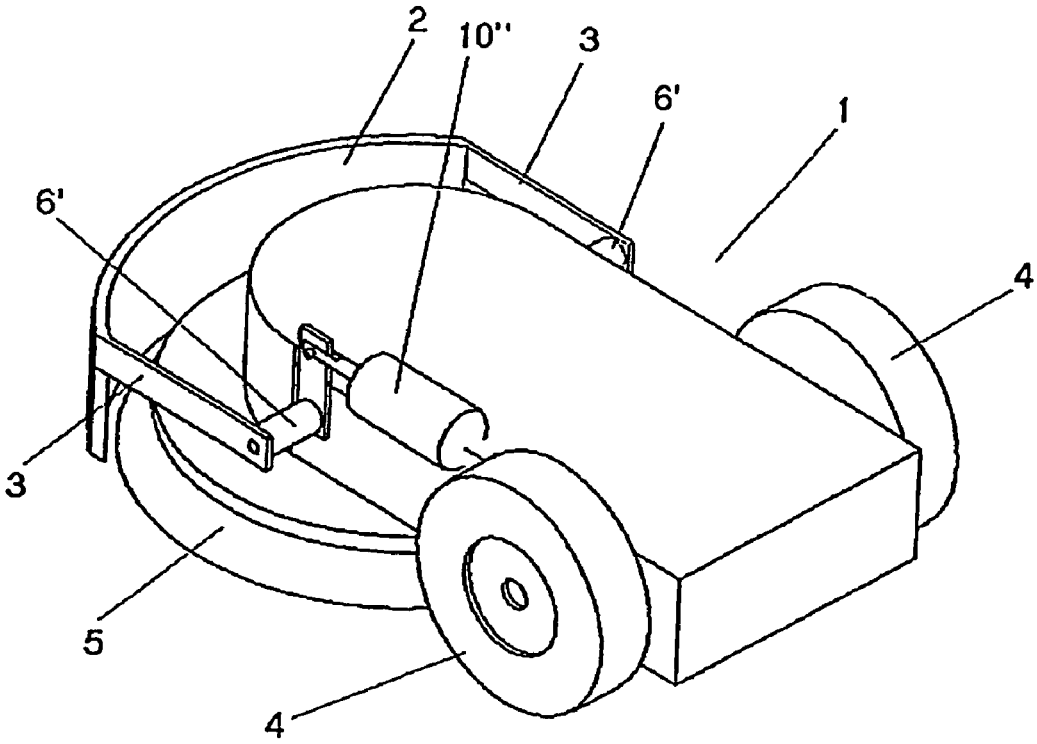

FIG. 4*a-c* illustrate a water slider for a floor cleaning machine 1 according to a fourth embodiment of the present invention. As in the second embodiment, the sliding unit 2 is connected to a bar 3 which is mounted on both sides of the machine via pivot points 6'. Instead of being raised and lowered automatically or intuitively via a connection to the rear wheels 4 or the steering handle 8 (thus, being operated in reaction to the actual moving direction of the machine) as in the first and second embodiments, or being raised and lowered manually via an actuation lever 7, 7', 7" as in the third embodiment, the sliding unit 2 is now raised and lowered electronically in response to a powered mechanism 10, 10', 10" which is steered by the electronics of the machine 1. Generally, the activation of the powered mechanism can be achieved in various ways—by direct activation when the machine 1 starts moving in a certain direction, by a separate switch which is activated independently, or via the electronic steering board which activates the powered mechanism to move the sliding unit 2 into the desired position as soon as it receives a signal to change the driving direction. In FIG. 4*a*, the raising/lowering of the sliding unit 2 is achieved by a linear motor 10 with a spindle drive. The spindle drive is directly connected to the sliding unit—which is mounted on both sides of the machine via a bar 3 with pivot points 6'—and raises and lowers it. In FIG. 4*b*, the raising/lowering of the sliding unit 2 is achieved by a rotary motor drive 10'. The rotary motor drive raises and lowers the sliding unit—which is mounted on both sides of the machine via a bar 3 with pivot points 6'—by rotating the bar around its pivot points to a certain extent. In FIG. 4*c*, the raising/lowering of the sliding unit 2 is achieved by a linear motor 10" which pneumatically, hydraulically or magnetically drives a lever connected to the sliding unit. The sliding unit is mounted on both sides of the machine via a bar 3 with pivot points 6' and is raised and lowered via the bar which is rotated around its pivot points to a certain extent by the lever being pulled backward and pushed forward, resp.

The cleaning operation with a machine 1 equipped with the water slider according to the present invention functions as follows. When a congested area with no turning space, f.e., the space below a table, is to be cleaned the machine 1 is moved forward under the table. Since the sliding unit 2 is lifted when the machine is moved forward, the water slider does not touch the ground during the forward movement of the machine under the table. When the machine has reached the end of the congested area, f.e., because a wall is reached, it is stopped and then drawn backwards in the opposite direction. Due to the backward movement of the machine, the sliding unit 2 is now lowered and touches the ground drawing fluid such as water, cleaning solution etc. with it. Finally, when the machine has reached on open area again it is turned around, and the fluid which has been pulled out of the congested area by the sliding unit 2 can now be picked up in a conventional manner by a rear squeegee (not shown) during a forward movement of the machine.

In all cases, the water slider can have a shape to fit different needs. In the cases described above, i.e. in combination with a disc system comprising a flat brush or pad rotating around an axis vertical to the ground, the sliding unit 2 can have an arched shape. In combination with a cylindrical system comprising a cylindrical brush rotating around an axis parallel to the ground, the sliding unit 2 can have a straight shape.

Furthermore, it should be noted that the system as mentioned above only operates satisfactory if supply with the cleaning solution is stopped when the machine is moved backwards. This can be achieved in different ways—either the supply is stopped automatically when the machine is moved backwards or it is stopped manually.

It is emphasized that the different embodiments of the water slider for a floor cleaning machine as mentioned above describe the invention by way of example only. Various alternatives are also in the scope of the present invention as defined in the appended claims. For example, the gear ends 11 and 12 of bar 3 and steering handle 8, resp., can engage in a different way than via teeth or friction layers at the outer surfaces of the gears. Furthermore, the brake pads 13 can be activated by separate means instead of being pressed by the ends of the bar 3. Furthermore, the motor drives 10, 10', 10" can have other designs than those disclosed above, and bar 3 and pivot points 6, 6' in the first, second and fourth embodiments can be provided on one side only.

The invention claimed is:

1. A water slider for a floor cleaning machine including a brush unit, comprising a sliding unit located in front of the brush unit which can be raised and lowered by an actuating mechanism, characterized in that the actuating mechanism includes a bar having at least one end which is connected to the machine via a pivot point and wherein the steering handle of the machine has at least one end which pivotally connects the handle to the machine, wherein the end of the bar forms a first gear and the end of the steering handle forms a second gear engaging the first gear to create a negative gear transmission such that the sliding unit is raised in response to pushing the handle forward and pivoting the handle toward the machine and the sliding unit is lowered in response to pulling the handle backward and pivoting the handle away from the machine.

2. The water slider according to claim 1, wherein the gear ends are toothed.

3. A water slider according to claim 1, wherein the sliding unit has an arched shape for use with a floor cleaning machine with a disc brush unit.

4. A water slider according to claim 2, wherein the sliding unit has an arched shape for use with a floor cleaning machine with a disc brush unit.

* * * * *

UNITED STATES PATENT AND TRADEMARK OFFICE

CERTIFICATE OF CORRECTION

PATENT NO. : 8,365,351 B2
APPLICATION NO. : 11/910643
DATED : February 5, 2013
INVENTOR(S) : Dieter Windmeisser It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1495 days.

Signed and Sealed this
First Day of September, 2015

Michelle K. Lee

Michelle K. Lee
*Director of the United States Patent and Trademark Office*